United States Patent [19]

Görner et al.

[11] Patent Number: 4,695,048

[45] Date of Patent: Sep. 22, 1987

[54] APPARATUS FOR SEPARATING DOCUMENTS

[75] Inventors: Horst Görner, St. Georgen; Walter Furstwängler; Walter Usbeck, both of Villingen-Schwenningen, all of Fed. Rep. of Germany

[73] Assignee: Mannesmann Kienzle GmbH, Fed. Rep. of Germany

[21] Appl. No.: 824,153

[22] Filed: Jan. 30, 1986

[30] Foreign Application Priority Data

Jan. 31, 1985 [DE] Fed. Rep. of Germany ..... 3503168

[51] Int. Cl.[4] ..... B65H 3/52

[52] U.S. Cl. ..... 271/122; 271/125

[58] Field of Search ..... 271/122, 124, 125

[56] References Cited

U.S. PATENT DOCUMENTS

| | | | |
|---|---|---|---|
| 2,670,954 | 3/1954 | Bach | 271/124 X |
| 3,825,248 | 7/1974 | Friend | 271/122 X |
| 3,902,712 | 9/1975 | Dorer | 271/125 |
| 4,034,976 | 7/1977 | Lundblad | 271/122 X |

FOREIGN PATENT DOCUMENTS

| | | | |
|---|---|---|---|
| 2332034 | 1/1975 | Fed. Rep. of Germany | 271/124 |

*Primary Examiner*—Richard A. Schacher

*Attorney, Agent, or Firm*—Toren, McGeady & Associates

[57] ABSTRACT

An apparatus for separating documents from one another includes two spaced-apart rollers which define a gap therebetween. The rollers rotate so that the surfaces which face one another move in opposite directions. One of the rollers serves to transport a document in the conveying direction, while the second countermoving roller serves to hold back any additional document which has been fed on top of the first document. The second roller is mounted so as to be pivotable, so that the gap between the rollers can be adjusted in accordance with the document conveyed through the gap. A guide roller serves to maintain the gap between the rollers. A storage container for the documents has movable rearward and bottom walls, wherein the rearward wall is biased by a tension spring so as to exert an essentially constant pressure on the stack of documents.

6 Claims, 3 Drawing Figures

APPARATUS FOR SEPARATING DOCUMENTS

BACKGROUND OF THE INVENTION

1. Field of the Invention

The present invention relates to an apparatus for separating documents from one another, wherein the documents are removed from a storage container and are fed to a conveying track.

2. Description of the Prior Art

Various types of documents must be separated during processing. For example, bank notes or other documents have to be separated from one another when they are processed in banks.

German Auslegesschrift No. 26 50 564 discloses an apparatus for separating documents in which the documents, for example, bank notes, are conducted between two rollers which rotate so that the surfaces which face one another move in opposite directions, wherein one of the rollers serves to transport a document in the conveying direction, while the second, countermoving roller serves to hold back any additional document which has been incorrectly fed toward the rollers. This known apparatus is based on the principle that the friction between the first conveying roller which is provided with an appropriate friction lining and the surface of the document is greater than the friction between the smooth surfaces of the documents.

In the known apparatus, between the two countermoving rollers an exactly defined distance must exist which corresponds to the thickness of a document. Accordingly, the gap between the rollers for the passage of the documents is exactly defined.

However, in processing documents there frequently occurs the problem of having to process documents having different thicknesses. For example, certain documents, such as checks or the like, are composed of only a single sheet of paper, while other types of documents are composed of three sheets of paper connected to one another through a perforated margin to form a single document. It is apparent that such documents composed of three sheets are much thicker than a simple check. The problem becomes even more difficult in the event that a document has been provided with a cover or jacket after it has been determined that the document is not legible. Since the cover surrounds the document, its thickness is even greater than that of the document composed of three sheets.

In the past, documents of different thicknesses had to be presorted and one type of document had to be processed at a time. An adjustment of the width of the gap between the rollers was required when different types of documents had to be processed.

It is, therefore, the primary object of the present invention to provide an apparatus for separating documents which is capable of processing documents having varying thicknesses without having to make adjustments in the apparatus during processing.

SUMMARY OF THE INVENTION

In accordance with the present invention, the apparatus for separating documents which are removed from a stack of documents and fed to a conveying track includes two rollers which are arranged spaced apart from one another and define a gap between them. The rollers rotate in such a way that the surfaces of the rollers at the gap move in opposite directions. The first of the two rollers serves to convey the documents in the desired conveying direction. The second of the rollers serves to hold back any document or documents which may be placed on the document being conveyed by the first roller. The second roller is arranged so as to be pivotable to a small extent, so that the width of the gap between the rollers is automatically adjusted in accordance with the thickness of the document being conveyed through the gap.

In accordance with another feature of the invention, the second roller is mounted on a rocking lever which can be pivoted between adjustable stops.

In order to facilitate the conveyance of the individual documents against the frictional force of the second roller, an easily rotatable guide roller is provided immediately downstream of the gap between the first and second rollers. The guide roller acts on the back side of the document and serves to maintain open the gap between the rollers when a document passes through the gap. Preferably, the guide roller is mounted on the axle of the second roller so as to be adjustable tangentially and in circumferential direction.

It has been found necessary to ensure that the documents are separated from one another to a certain extent as they are being removed from the storage container. This object can be attained if it is ensured that the documents are pressed with a virtually constant pressure against a feed roller which feeds the documents toward the countermoving rollers. In addition, the losses due to friction must be essentially avoided during the advancement of the document stack toward the feed roller.

In accordance with the present invention, the storage container for the documents has in addition to a conventional movable rear wall, a movable bottom wall and a long tension spring which acts on the movable parts so as to exert an essentially constant pressure on these movable parts independently of the thickness of the document stack.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
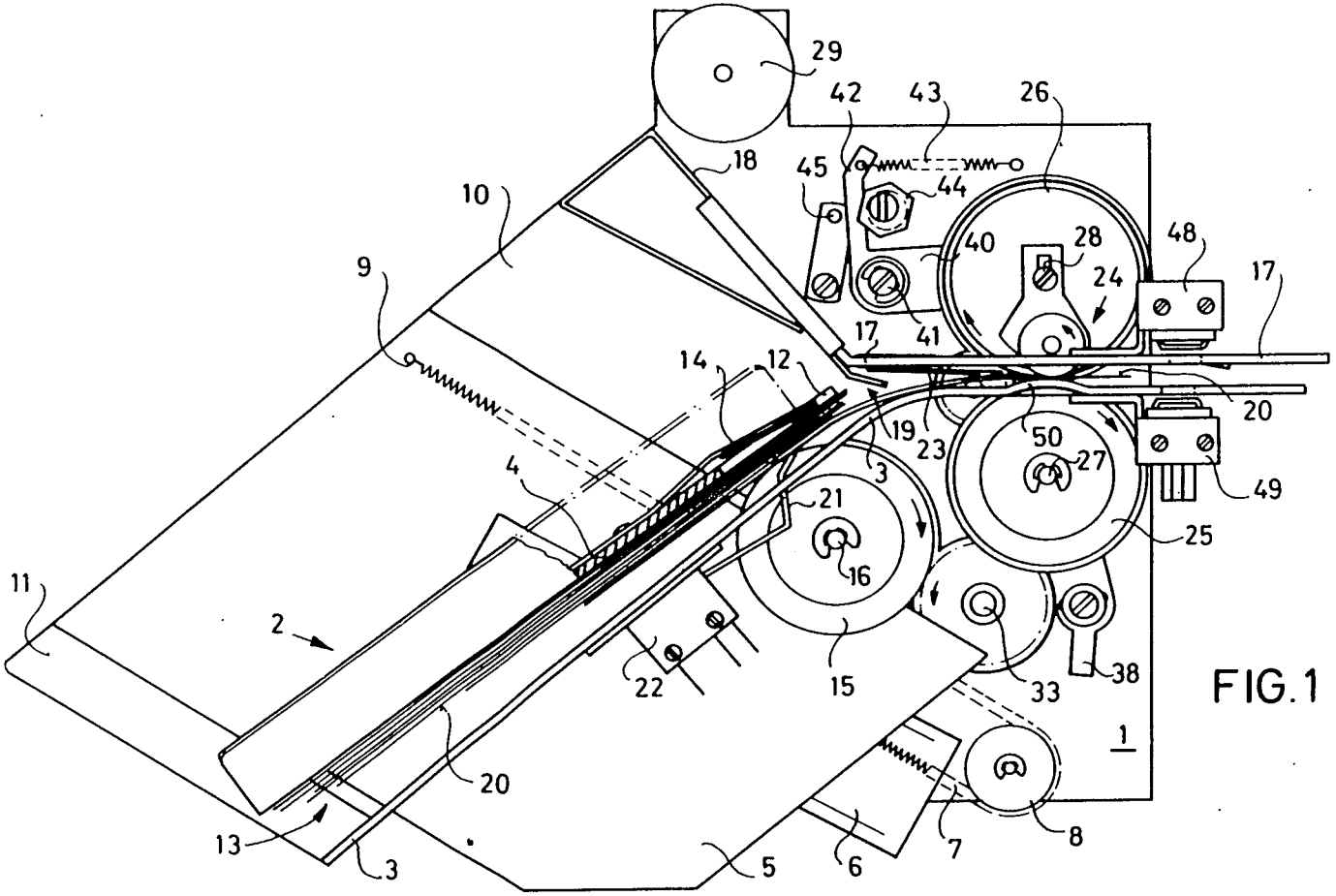
FIG. 1 is a schematic elevational view of the apparatus for separating documents in accordance with the present invention including a storage container.

As illustrated in FIG. 1, the apparatus according to the invention includes a support plate 1 and a storage container 2 mounted on plate 1. Storage container 2 includes a bottom wall 3 and a movable top wall 4. Top wall 4 is connected to a movable structural component which forms a side wall 5. Side wall 5 is movably mounted on a guide member 6. The component composed of top wall 4 and side wall 5 is biased toward bottom wall 3 by a long tension spring 7 which is guided around a roller 8 and connected to a pin 9. Side wall 5 is movable on guide member 6 between two fixed surfaces 10 and 11 which, together with movable guide member 6, form the side of storage container 2. Wall 5 slightly projects above the plane of surfaces 10 and 11, so that the documents of stack 13 make contact only with wall 5. Top wall 4 is guided between surfaces 10 and 11 inclined in such a way that top wall 4 rests only with its front end against stack 13. In order to ensure satisfactory friction between the frontmost documents 20 and the last document, top wall 4 has a tongue with a friction lining 14 which bears against the rearmost document.

A feed roller 15 provided with a friction lining is mounted on an axle 16 and ensures that the frontmost document 20 of stack 13 is pulled out of storage container 2 and fed between two walls 3 and 17. A transversely extending guide member 18 is connected to wall 17 and forms an angle with wall 3, so that a funnel-type inlet opening 19 is created. An end switch 22 with a sensor arm 21 serves to interrupt completely the document conveyance when the document stack 13 has been processed.

The storage container 2 described above and illustrated in FIG. 1 provides the advantage that the documents are neatly advanced with decreasing document stack during the introduction of the documents in the conveying path, because the documents rest upon a movable bottom wall and the pressure upon the document stack remains relatively constant independent of its thickness, so that during the removal of the documents from the stack by means of the feed roller 15 it is already ensured that not too many documents are conveyed at the same time.

The documents 20 passing between walls 3 and 17 are conducted past a friction lining 23 which is fastened to wall 17 and serves initially to separate the documents from one another. Friction lining 23 ensures that if two documents are conveyed by means of feed roller 15 toward the inlet passage 19 the document on top is slightly delayed, so that the document at the bottom is conveyed ahead of the one on top.

A separating station 24 includes a first roller 25 mounted on axle 27 which rotates clockwise as viewed in FIG. 5 and serves to convey in the conveying direction. Station 24 also includes roller 26 mounted on axle 28 and driven so that the surfaces of the rollers 25 and 26 facing one another move in opposite directions. Second roller 26 has the purpose of holding back any document or documents which may be placed on the document being conveyed by first roller 25. Rollers 25 and 26 are provided with friction linings. In particular, second roller 26 and feed roller 15 are lined with the material named Linatex. This material has been found particularly useful because it has the required friction coefficient and low wear.

Figure 1A:
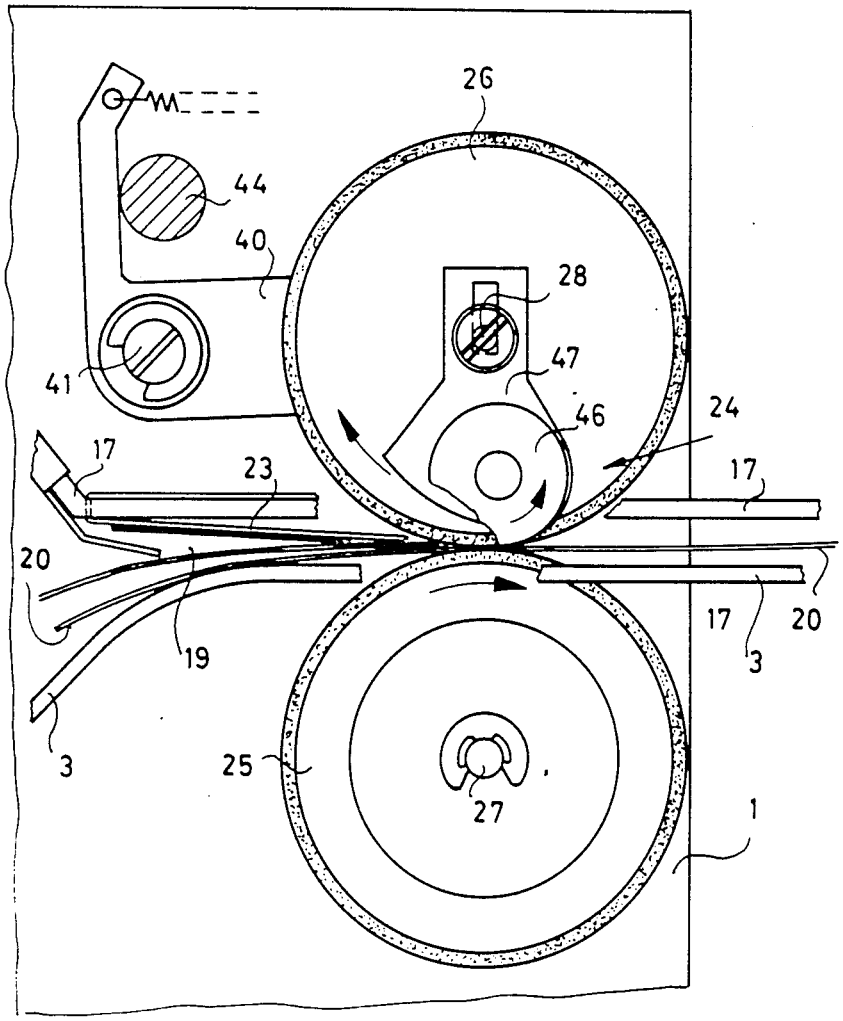
FIG. 1A is an enlarged view of the countermoving rollers forming part of the apparatus according to the invention.
Figure 2:
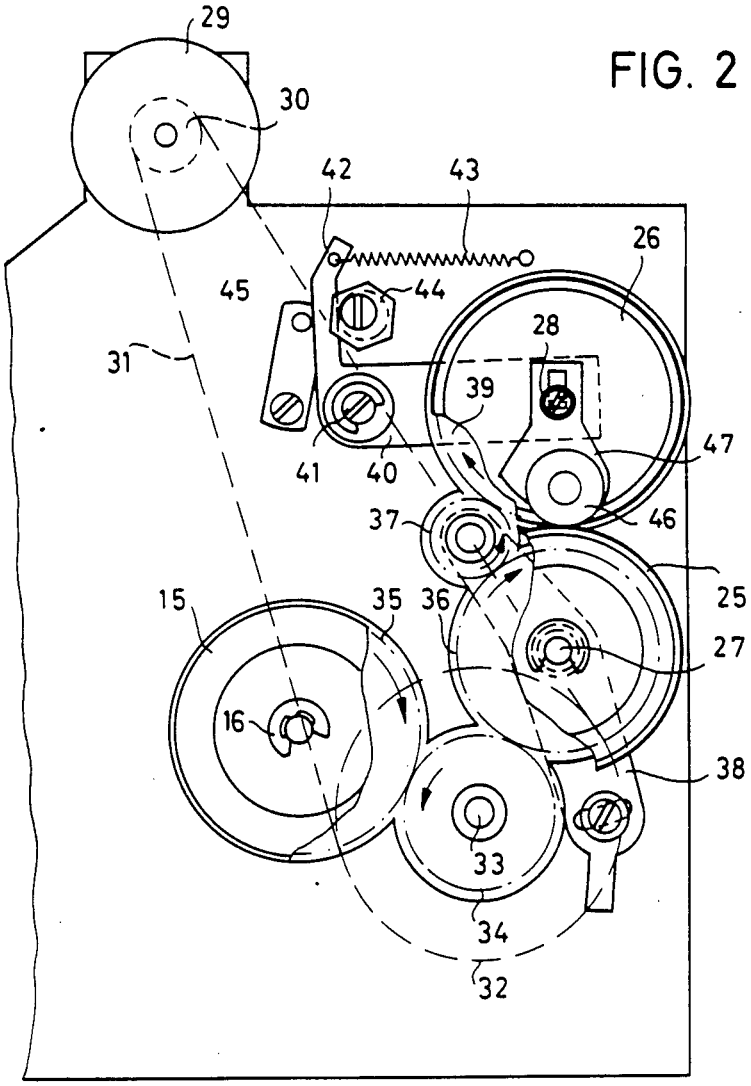
FIG. 2 is an elevational view of the drive assembly for driving the apparatus according to the invention.

Separating station 24 is illustrated in detail in FIG. 1A and its drive assembly is illustrated in detail in FIG. 2. A motor 29 drives a pulley 32 through a pulley 30 and a belt 31. An axle 33 connects pulley 32 with a gear 34. Gear 34 engages a gear 35 which is mounted on axle 16 and drives roller 15. Gear 34 also meshes with a gear 36 which is mounted on axle 27 and is connected to roller 25. Gear 36, in turn, drives a gear 37 which is mounted on a lever 38. Gear 37 is in engagement with a gear 39 which is mounted on axle 28 and is connected to roller 26. Axle 28 is mounted on a rocking lever 40. Rocking lever 40 pivots about pin 41 and is provided with an arm 42. A tension spring 43 acts on arm 42. Lever 40 is pivotable about pivot pin 41 between two adjustable stop members 44 and 45. The maximum extent of the pivoting movement is such that the thickest documents may pass between rollers 25 and 26.

As can be seen in the drawing, stop member 44 is mounted eccentrically, so that the basic position of roller 26 is adjustable in such a way that the thinnest document may pass between rollers 25 and 26. FIG. 1A shows that a single document 20 is moved between the two rollers 25 and 26, while another document 20 following the first document 20 is held back by countermoving roller 26. The document following the first document 20 is held back until the first document 20 has passed through the gap formed between the rollers 25 and 26.

Since roller 26 is driven to move counter to the roller 25, the conveyance of the documents through the gap between the rollers is made difficult. In order to somewhat facilitate the conveyance of the documents, an additional guide roller 46 is provided rotatably mounted on a support member 47. Support member 47 is mounted on axle 28 by means of an oblong slot and a corresponding screw, so that the position of guide roller 46 is adjustable tangentially and in circumferential direction. The adjustment of the guide roller is such that its outermost point of adjustment is offset approximately 1° to 2° relative to the point where the surfaces of the rollers 25 and 26 are closest together, that is, at the point where the documents are grasped and conveyed.

In addition, guide roller 46 projects slightly beyond the periphery of roller 26. Thus, if roller 26 is caused by a thick document 20 to be pivoted counterclockwise as viewed in FIG. 1, this document makes contact after having traveled a short distance with guide roller 46 and thereby causes a slight additional pivoting of roller 26. In so doing, guide roller 46 rolls on the back side of the document, while no load is applied to roller 26. Wall 3 has a bulging portion 50 located opposite guide roller 46, so that the interaction of guide roller 46 and the bulging portion 50 facilitate the conveyance of the documents 20.

Downstream of rollers 25 and 26 is provided a light barrier 48, 49 which generates a switch-off pulse as soon as a desired number of documents have passed barrier 48, 49, so that motor 29 is switched off and no additional documents are supplied.

While the specific embodiment of the invention has been shown and described in detail to illustrate the application of the inventive principles, it will be understood that the invention may be embodied otherwise without departing from such principles.

We claim:

1. An apparatus for separating documents, comprising storage means for a stack of documents, spaced apart first and second rollers having circumferential surfaces and parallel axes, said rollers defining a gap therebetween, said second roller mounted on an axle, means for feeding the documents from said storage means into said gap, said first roller driven to rotate so as to convey the documents through said gap, said second roller driven so that said surfaces of said rollers at said gap move in opposite directions, said second roller holding back any document placed on the document conveyed by said first roller, said second roller mounted pivotable about a pivot axis, wherein the width of said gap is adjustable in accordance with the thickness of the document conveyed through said gap, a guide roller immediately downstream of said gap, and a support member for connecting said guide roller to said axle of said second roller, said guide roller mounted to project slightly beyond the periphery of said second roller so as to make contact with a document conveyed through said gap and to slightly widen said gap during the conveyance of a document through said gap.

2. The apparatus according to claim 1, wherein the position of said guide roller is adjustable relative to said axle.

3. The apparatus according to claim 1, comprising two adjustable stop means, wherein said second roller is pivotable between said stop means.

4. The apparatus according to claim 1, comprising friction means located upstream of said gap, said friction means holding back any document placed on the document conveyed by said feeding means.

5. The apparatus according to claim 1, said storage means comprising a fixed bottom wall and movable top and side walls, and a tension spring for biasing said top wall with essentially constant pressure against said stack of documents.

6. The apparatus according to claim 1, wherein said top wall defines an angle with said bottom wall, and wherein a friction lining is provided on said rearward wall opposite said feeding means.

* * * * *